US005748836A

United States Patent [19]

Moore et al.

[11] Patent Number: 5,748,836

[45] Date of Patent: May 5, 1998

[54] LOCKING MECHANISM FOR VAPORIZER ELECTRODE HOUSING UTILIZING ELECTRICAL PLUG PRONG AS KEY

[75] Inventors: Devin Lee Moore, Decatur; John A. McMillan, Atlanta; Joseph J. Kopp, Jr., Decatur, all of Ga.

[73] Assignee: Sunbeam Products, Inc., Delray Beach, Fla.

[21] Appl. No.: 372,588

[22] Filed: Jan. 13, 1995

[51] Int. Cl.[6] ..... F22B 1/30; H05B 3/60

[52] U.S. Cl. ..... 392/337; 392/313; 20/210

[58] Field of Search ..... 392/337, 336, 392/313, 333, 324, 406, 405; 220/210, 293, 297; 70/387, 336

[56] References Cited

U.S. PATENT DOCUMENTS

| | | | |
|---|---|---|---|
| 3,538,306 | 11/1970 | Brunell . | |
| 3,579,262 | 5/1971 | Peeps . | |
| 3,579,263 | 5/1971 | Corbett et al. | 392/335 |
| 3,705,415 | 12/1972 | Katzman et al. | 392/337 |
| 3,973,687 | 8/1976 | Glick | 220/210 |
| 4,243,870 | 1/1981 | Grime et al. . | |
| 4,288,684 | 9/1981 | Katou et al. . | |
| 4,338,510 | 7/1982 | Chihara et al. | 392/337 |
| 5,291,579 | 3/1994 | Marino | 392/406 |

FOREIGN PATENT DOCUMENTS

| | | | |
|---|---|---|---|
| 2446014 | 4/1975 | Germany | 392/337 |
| 403260 | 12/1933 | United Kingdom | 392/405 |

*Primary Examiner*—John A. Jeffery
*Attorney, Agent, or Firm*—Michael J. Kline; Carol I. Bordas

[57] ABSTRACT

A heating unit assembly for vaporizers having a cover member, a heating unit housing, a heating unit holder and a locking mechanism which prevents the removal of both the cover member and the heating element while the vaporizer is operational. Preferably, the locking mechanism is the combination of at least one flexible locking finger and a post member and is provided with a key member. The key member is the prong of an electrical power cord plug which is inserted into the cover. The heating unit assembly also provides a connecting member which locks the cover member to the heating unit housing.

17 Claims, 13 Drawing Sheets

LOCKING MECHANISM FOR VAPORIZER ELECTRODE HOUSING UTILIZING ELECTRICAL PLUG PRONG AS KEY

BACKGROUND OF THE INVENTION

1. Field of the Invention

This invention relates to connecting and locking mechanisms for a vaporizer which prevents the heating unit from being exposed and separated from the rest of the vaporizer while the vaporizer is in operation. More particularly, this invention concerns connecting and locking mechanisms which discourages the combination of the cover and the heating unit holder of an electrical steam vaporizer from being removed from the heating unit housing while the vaporizer is in use.

2. Description of Related Art

Conventional vaporizers are used to provide moisture to the air in homes. In addition to adding moisture, a vaporizer can be used to inject remedies mixed with steam into the air for treating respiratory problems. Typically, a vaporizer comprises a water reservoir and a heating unit. Commonly, the heating unit includes a protective sleeve that surrounds a heating element which contacts water in the reservoir. Although the heating element can take many forms such as an electrical resistance-type heating element, the heating element generally comprises two electrodes that are positioned parallel to one another. When the reservoir is filled with water and a voltage source is connected to the two electrodes, a current will flow between the two electrodes and through the water therebetween. The flow of current between the electrodes will heat the water to a boil thus, vaporizing the water.

After extended use of the vaporizer, the electrodes will corrode and need to be cleaned. In order for the electrodes to be cleaned, the protective sleeve they must be removable from the protective sleeve. If the electrodes are removed while the vaporizer is in operation, there is a danger of the user being electrically shocked. Therefore, it is necessary to provide some mechanism which will prevent or make it less likely that the electrodes will be exposed while the vaporizer is still in operation. On the other hand, the structure of the vaporizer can not be prohibitive of the cleaning of the electrodes.

Further, vaporizers are often placed on the floor while in operation making them susceptible to being overturned by a person walking in the area or a child playing next to the vaporizer. As a result of the vaporizer being overturned boiling water may be ejected from the steam outlet or the vaporizer heating element may be disassembled from the reservoir both of which may cause severe injury to a person. Therefore, there is a need for a vaporizer locking mechanism which substantially reduces the risk of exposing a person to bare electrodes while the vaporizer is in operation and of boiling water being emitted from the outlet while not making the cleaning of the electrodes difficult.

One type of prior art electrical steam vaporizer provides a locking mechanism which breaks the electrical circuit whenever the top is removed from the vaporizer base. An example of this type of steam vaporizer is described in U.S. Pat. No. 3,579,262 issued to Peeps. Peeps discloses an electrical power cord connected to two electrodes at one end of the electrical power cord and an electrical plug connected at the other end of the electrical power cord. The electrical power cord is severed between the two ends and connection terminals are created on each of the two severed parts of the electrical power cord. The electrical circuit is completed and the electrodes receive a current when the two connection terminals are connected by being placed on a conductive rod. The two parts of the electrical power cord are of a length that any movement of the heating unit separates the terminals from one another thus, disrupting the electric circuit and cutting-off the current flow to the electrodes.

In one embodiment, Peeps provides for the connection terminals to be able to move relative to one another therefore, it is possible that the current flow can be disrupted anytime the vaporizer is overturned or moved. In another embodiment, Peeps discloses fixedly connecting the two terminals together by extending a screw therethrough. A person trying to clean the electrodes would need to employ a tool to disconnect the terminals before he could reach the electrodes for cleaning making the structure prohibitive of the cleaning of the electrodes. Further with either embodiment, the connection terminals are susceptible to being deformed from the repetitive opening and closing of the connection which will fatigue and break down the electrical connection.

Another prior art device which requires the electrical power cord or the vaporizer to be disconnected prior to cleaning the electrodes is described in U.S. Pat. No. 4,288,684 issued to Katou et al. Katou et al. disclose a steam vaporizer having a cover extending over the heating element. The cover has an upper concave portion which is a plug-in aperture for the power source connector of the electrical power cord. In order for the electrodes to be cleaned, the power source connector must be disconnected at the plug-in aperture before the cover can be removed and the electrodes cleaned. The plug-in aperture is made of plastic which is a less sturdy connection than the connection of the electrical plug into the electrical wall outlet. As mentioned above, repeated disconnecting and connecting of the power source connector at the plug-in aperture may cause break down of both the electrical connection and the plastic structure of the vaporizer resulting in the vaporizer becoming non-functional.

The prior art also teaches vaporizers having a locking mechanism which prohibits the removal of the heating element from the water reservoir unless the electrical plug is used as a key to disengage the locking mechanism. One example of this type of prior art device is U.S. Pat. No. 3,538,306 issued to Brunell which discloses a vaporizer having a cover which cannot be removed unless the prongs of an electrical power cord plug are inserted in openings in the cover. The prongs contact a spring biased bolt and move the bolt into engagement with one end of a lever which pivots the lever about its center point so that the other end of the lever contacts a second bolt and then disconnects the second bolt from the vaporizer allowing the cover to be removed from the vaporizer and the electrodes to be cleaned. The problem with this vaporizer is that the locking mechanism connects the removable top to the base at only one point creating a build-up of stress at one-point. If the connection fails there is nothing to prevent the electrodes from being removed from the reservoir while the vaporizer is in operation.

U.S. Pat. No. 4,243,870 issued to Grimes et al. teaches using prongs of an electrical plug as a key to allow access to the electrodes for cleaning. Grimes et al. disclose an electrical steam vaporizer having a water reservoir with a cover that completely envelopes a vaporizer cell assembly. The vaporizer cell assembly includes an electrode assembly and a protective sleeve surrounding the electrode assembly. The electrode assembly is locked to the protective sleeve by an interlocking tab. In order for the user to clean the electrodes, he must remove the cover, insert one of the prongs of the electrical power cord into a key opening in the protective sleeve in order to disengage the interlocking tab and turn the electrode assembly to align projections spaced equi-distance around the electrode assembly with openings formed between overhanging lips. The problem with this vaporizer locking mechanism is that the cover of the vaporizer can be removed prior to turning off the vaporizer exposing a steam outlet port. Thus, the vaporizer is in operation and the vaporizer could be overturned resulting in the spilling of the boiling water.

No where in the prior art mentioned above is there disclosed a vaporizer having a locking mechanism which prevents the vaporizer cover from being removed to expose the heating unit while the vaporizer is in operation and which also provides a second mechanism that must be activated before the electrodes can be removed from the protective electrode housing. Therefore, there is a definite need for a locking mechanism for a vaporizer which substantially reduces the risks of exposing a person to electrodes while the vaporizer is in operation or the spilling of boiling water.

SUMMARY OF THE INVENTION

Accordingly, the presently preferred embodiment provides an electric steam vaporizer having a water reservoir and a heating unit assembly. The heating unit assembly comprises with a heating unit housing, a heating unit holder, a cover and a locking mechanism that will prevent the combination of the cover and the heating unit holder from being removed from the heating unit housing while the vaporizer is in operation thus greatly reducing the risk of the heating unit being removed from the heating unit housing.

The locking mechanism of the presently preferred embodiment can take form of a combination of at least one flexible locking finger and post member although other locking mechanisms may be used. Although it is preferred that the at least one flexible locking finger be mounted on the heating unit holder and the post member be mounted on the heating unit housing, the at least one flexible locking finger may be mounted on the heating unit housing and the post member may be mounted on the heating unit holder. In the locked position, the at least one flexible locking finger will engage the post member preventing the separation of the combination of the cover and the heating unit holder from the heating unit housing.

The flexible locking fingers can be made from a plastic material which is flexible enough to undergo repetitive bending. Preferably, the locking fingers as well as the other parts of the heating unit assembly are made from a plastic such as polypropylene.

The locking mechanism of the presently preferred embodiment is provided with a locking mechanism that is unlocked using a key member. Preferably, the key member is the prong of an electrical power cord plug which is inserted into the cover thus, substantially increasing the probability that the heating unit assembly can not be dismantled when the vaporizer is in use.

A connecting mechanism is also provided which prevents rotational movement and separation of the combination of the cover and the heating unit holder from the heat unit housing. The connecting mechanism can take the form of multiple openings and corresponding projections each of which can be part of either the heating unit holder or the heating unit housing, as is the case with the locking mechanism. To engage the connecting mechanism the projections must be aligned with the corresponding openings and then the heating unit holder must be rotated relative to the heating unit housing. Both the openings and the projections are preferably L-shaped. In order to remove the electrodes from the reservoir for cleaning one must unlock the connecting mechanism in addition to, first deactivating the locking mechanism.

Other details, objects and advantages of the presently preferred embodiment will become more apparent as the following description of the present invention.

BRIEF DESCRIPTION OF THE DRAWING

The accompanying drawings show a presently preferred embodiment of the invention in which.

DETAILED DESCRIPTION OF THE PRESENTLY PREFERRED EMBODIMENT

Although this invention is suitable for use in a variety of vaporizers such as vaporizers having a heating element that is a electrical heat-resistant element, it will be described in relation to use with an electrical steam vaporizer having a heating element in the form of two electrodes. Such description is solely for the purpose of explanation and is not intended to limit the scope of this invention.

Figure 1:
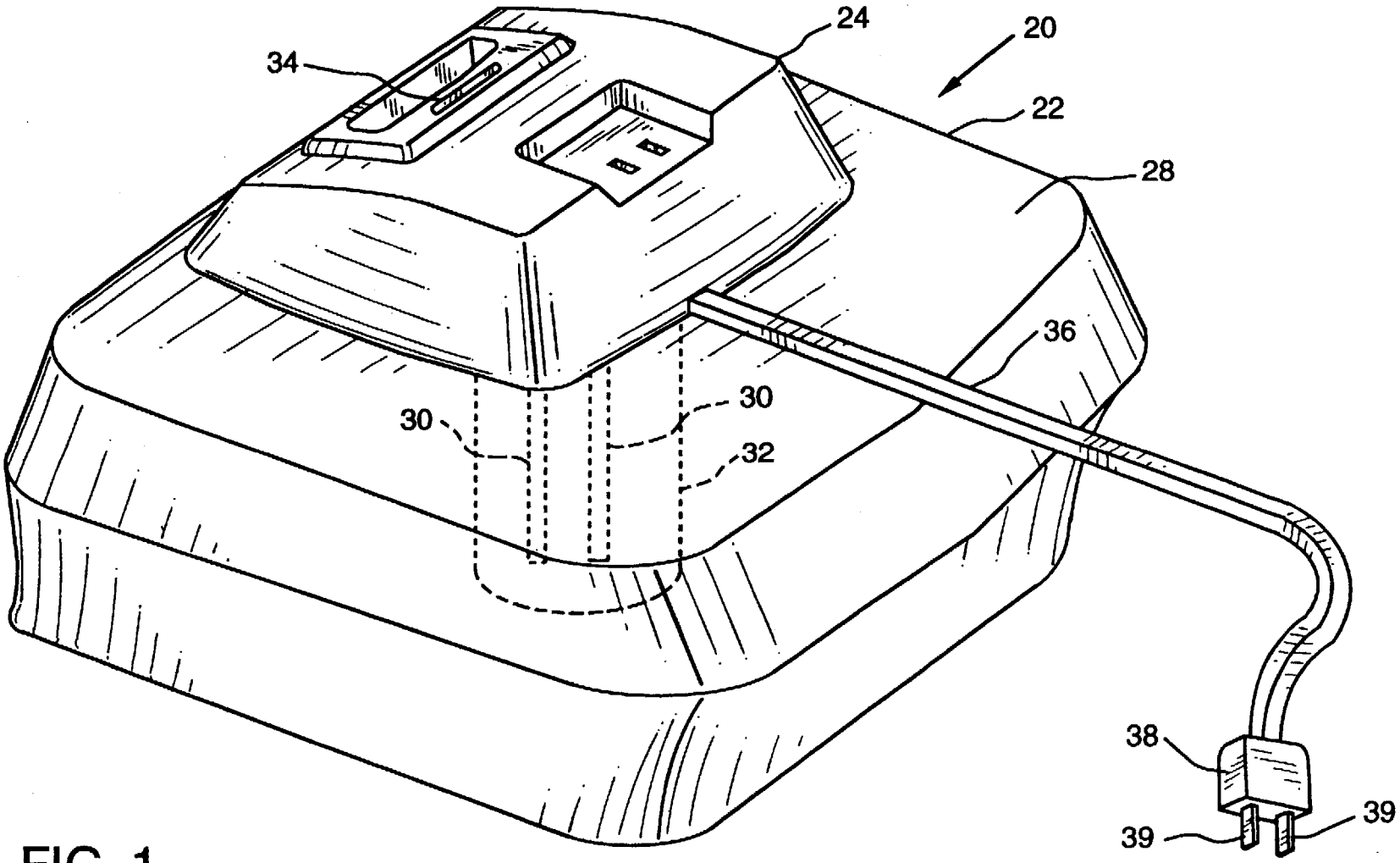
FIG. 1 is a perspective view of an electrical steam vaporizer having a heating unit assembly employing the presently preferred embodiment of the invention.

FIG. 1 illustrates a vaporizer 20 having a water reservoir 22 and a heating unit assembly 24. Although the reservoir 22 is shown in the shape of a substantially three-dimensional rectangle, the reservoir 22 can be many other configurations such as frusto-conical or cubical. The water reservoir is provided with a ledge around the circumference in order to make it easier to grip. The water reservoir 22 has an opening 16 (not shown) on its top surface 28. The water reservoir 22 is made from a plastic material which is preferably high-density polyethylene, although other materials can be used.

The heating unit assembly 24 extends through the reservoir opening into the interior of the reservoir 22. A pair of electrodes 30 are contained within the heating unit assembly 24 and come into contact with water in the reservoir 22. An aperture 34 is provided in the heating unit assembly 24 which allows vapors created by the vaporizer to be emitted into the atmosphere. An electrical power cord 36 has an electrical plug 38 at one end and is attached to the heating unit assembly 24 at the other end. In operation, the electrical plug 38 is plugged into an electrical wall outlet (not shown) and a current passes through the electrical wires, between the electrodes and through the water in the reservoir 28. The water will be heated and thus, vaporized into steam. The steam will be emitted from the heat assembly unit aperture 34 into the atmosphere.

Figure 2:
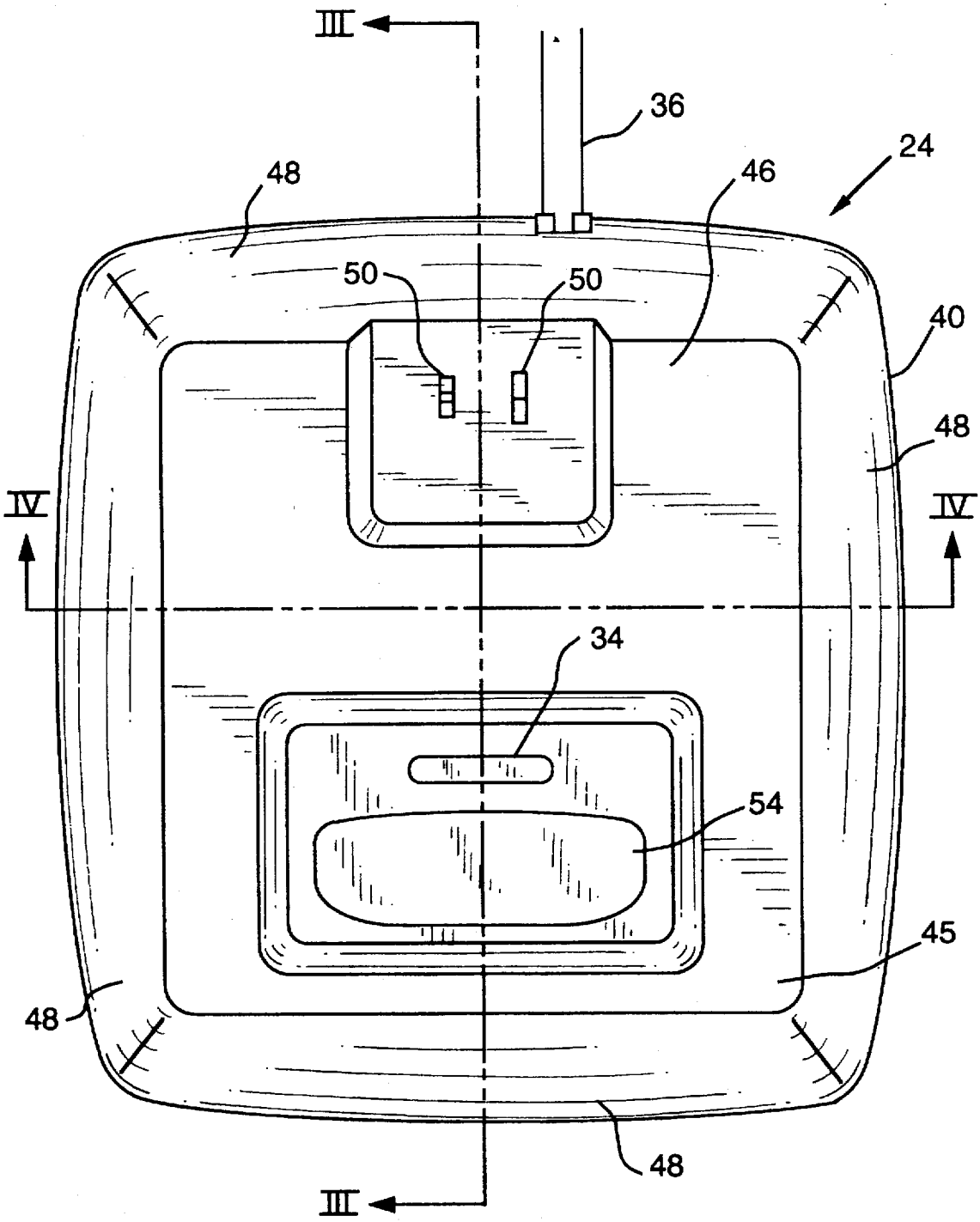
FIG. 2 is a top planar view of the heating unit assembly shown in FIG. 1.
Figure 3:
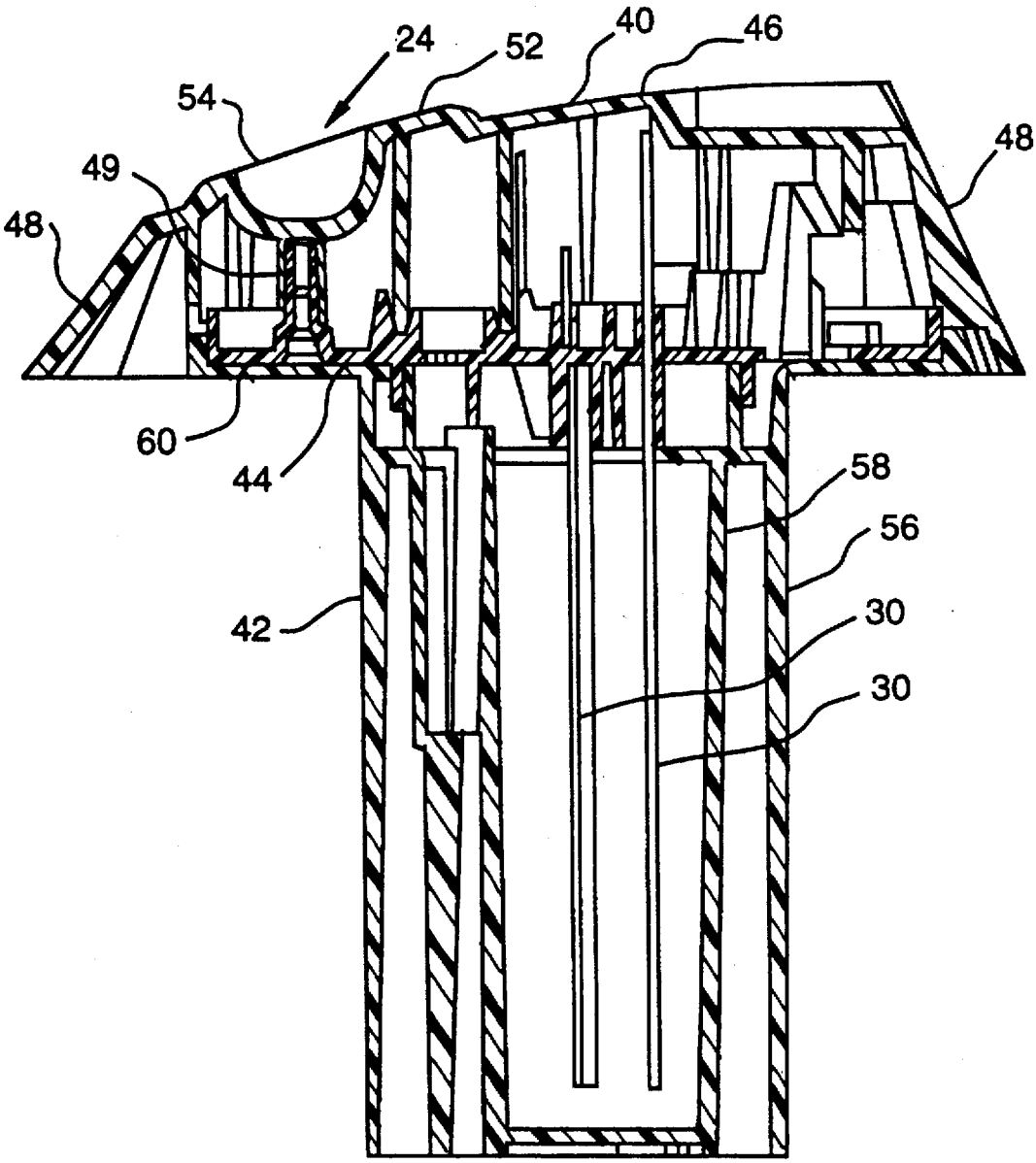
FIG. 3 is a sectional view of the heating unit assembly shown in FIG. 2 taken along line III—III.
Figure 4:
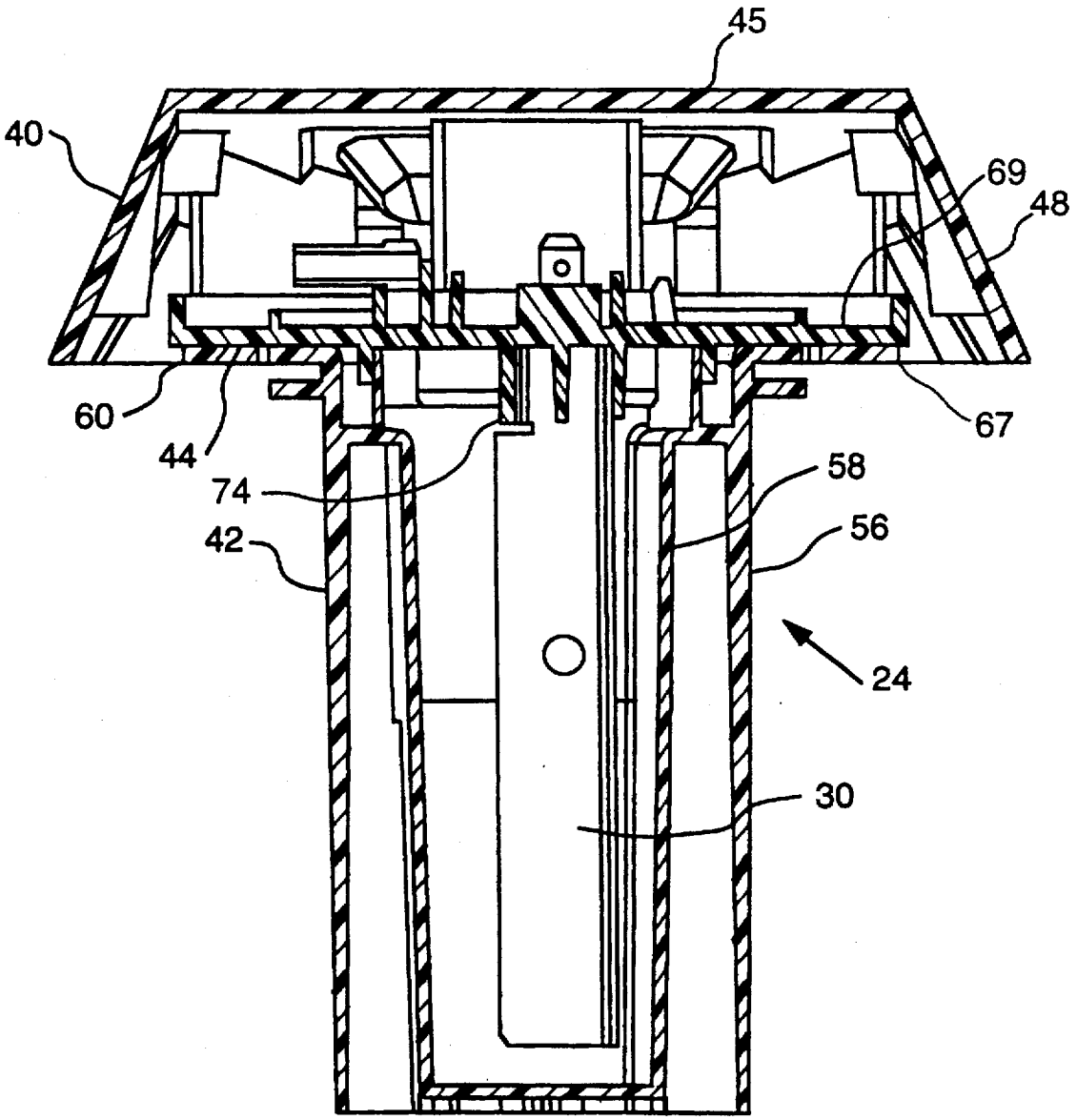
FIG. 4 is another sectional view of the heating unit assembly shown in FIG. 2 taken along line IV—IV.
Figure 5:
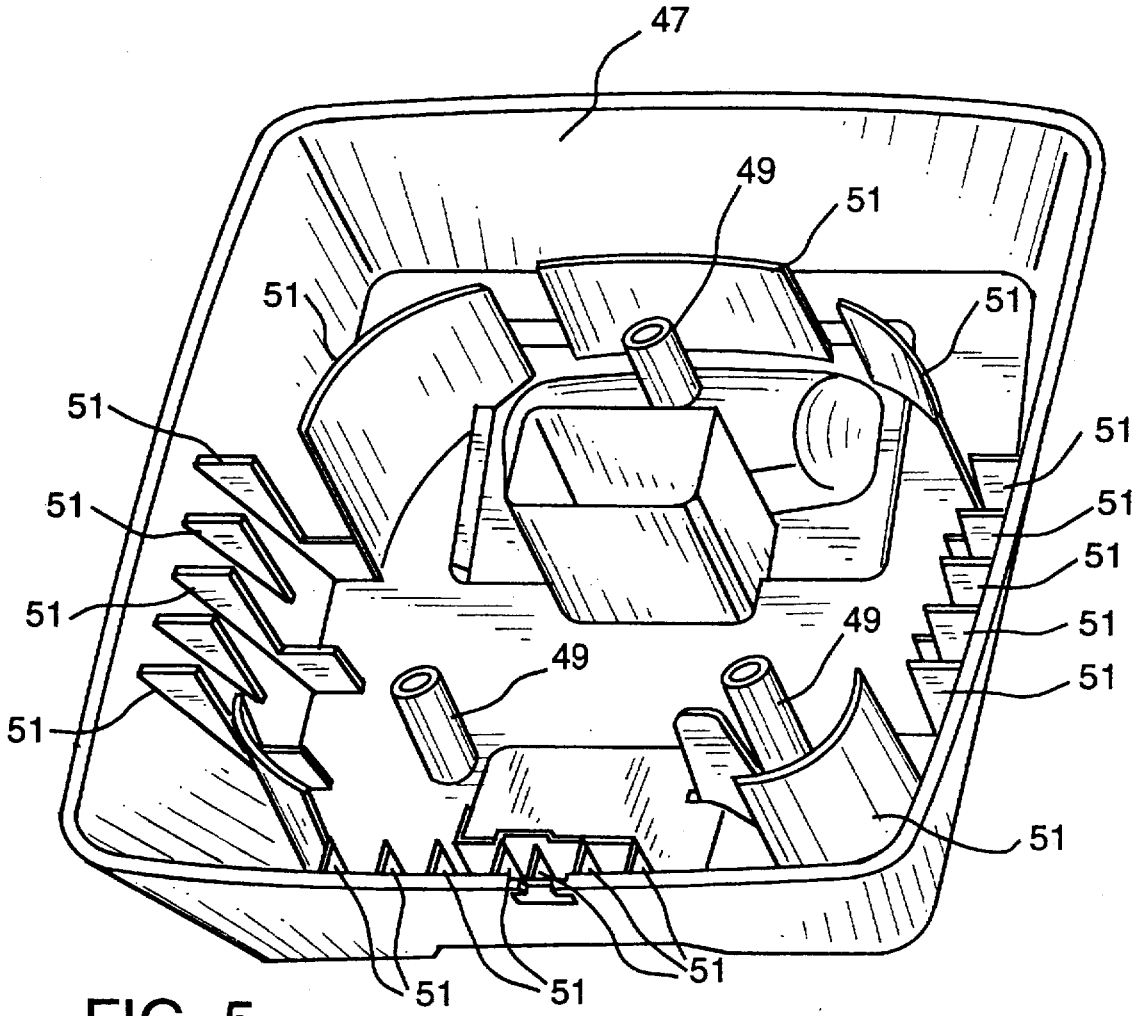
FIG. 5 is a bottom perspective view of a cover member of the heating unit assembly shown in FIG. 1.

Referring to FIGS. 2 through 4, the heating unit assembly 24 is illustrated having a cover member 40, a heating unit housing 42 and a heating unit holder 44 all of which are made from a plastic material, preferably polypropylene. The cover member, shown in detail in FIGS. 2 through 5, has a top portion 45 and bottom portion 47, a top sloping surface 46 and four sides 48 also sloping downward. The cover member 40 further includes apertures 50 on the top sloping surface 46 as well as aperture 34 that extends through the cover member 40 from the top portion 45 to the bottom portion 47 and an indented portion 54 for holding medicaments for the treatment of respiratory problems. The cover member 40 also includes a hole in one of its sides 48 for the electrical cord 36 to extend therethrough. The bottom portion 47 of the cover member 40 has three boss members 49 that provide for a connection between the cover member 40 and the heating unit holder 44. Multiple fins 51 are positioned around the outer portion of the bottom portion 47 of the cover member 40 to prevent intrusion into the wiring area. The heating unit housing 42, shown in detail in FIGS. 6 through 10, has a generally cylindrical exterior body 56 which is concentric with another generally cylindrical interior body 58 and a flange 60. The cylindrical body 58 acts as a protective sleeve for the electrodes 30. The flange 60 extends substantially perpendicular from the top portion of the exterior cylindrical body 56. The interior surface 59 of the interior cylindrical body 58 is angularly shaped having six surfaces. Although the interior body 58 and the exterior body 56 of the heating unit housing 42 are generally angular and cylindrical, respectively, many different forms such as rectangular or square can be used.

Figure 6:
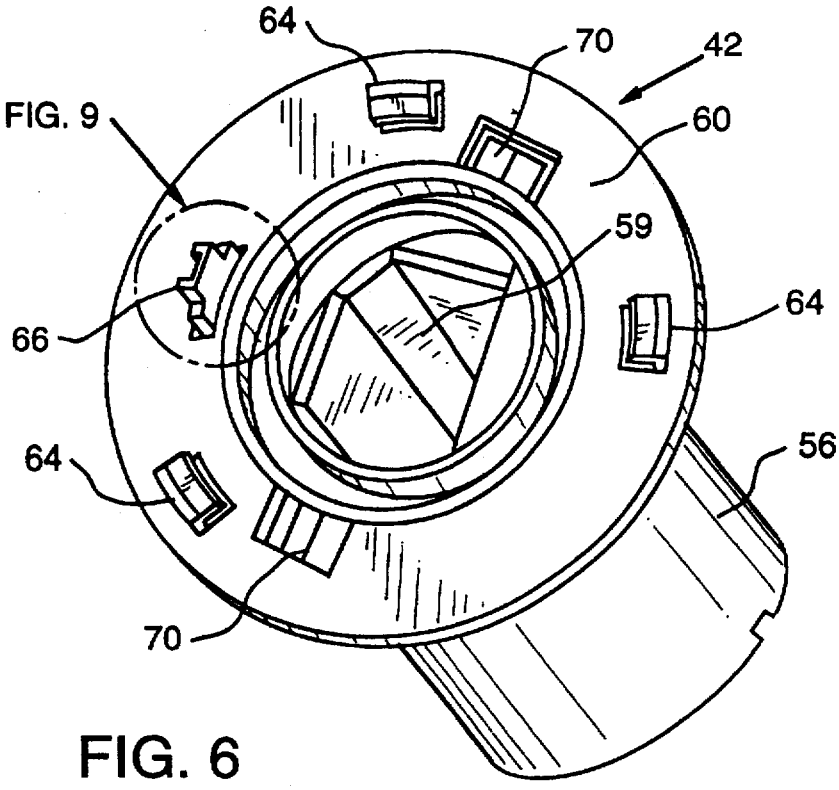
FIG. 6 is a top perspective view of the heating unit housing of the presently preferred embodiment of the heating unit assembly shown in FIG. 1.
Figure 7:
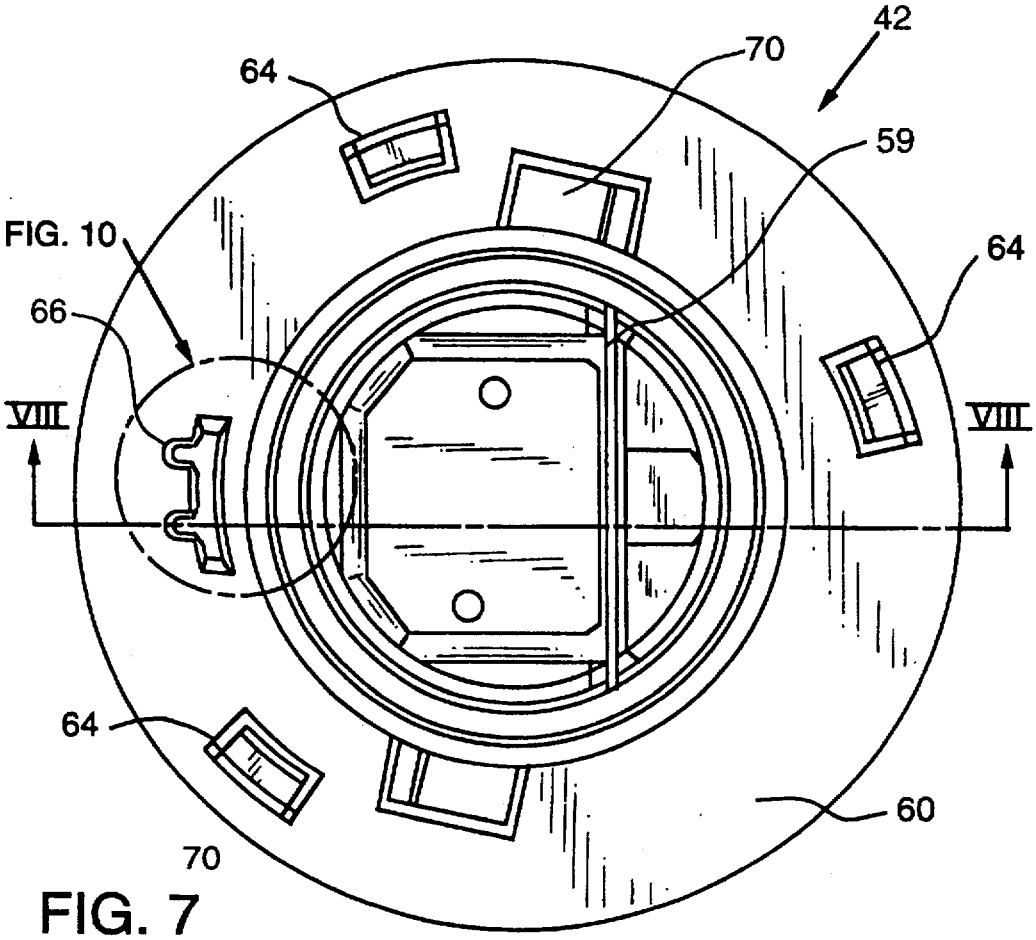
FIG. 7 is a top planar view of the heating unit housing shown in FIG. 6.
Figure 8:
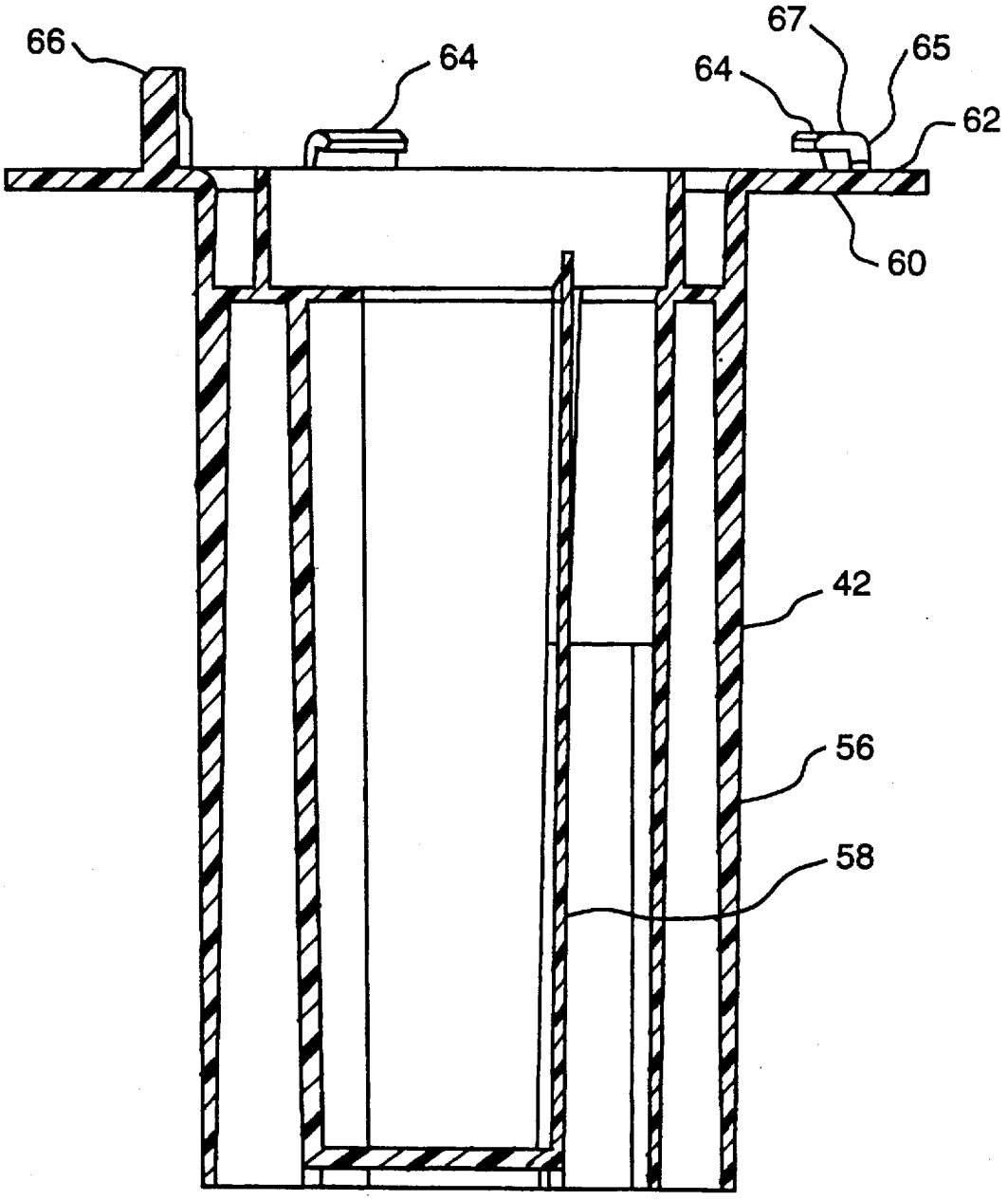
FIG. 8 is a sectional view of the heating unit housing shown in FIG. 7 taken along line VIII—VIII.
Figure 9:
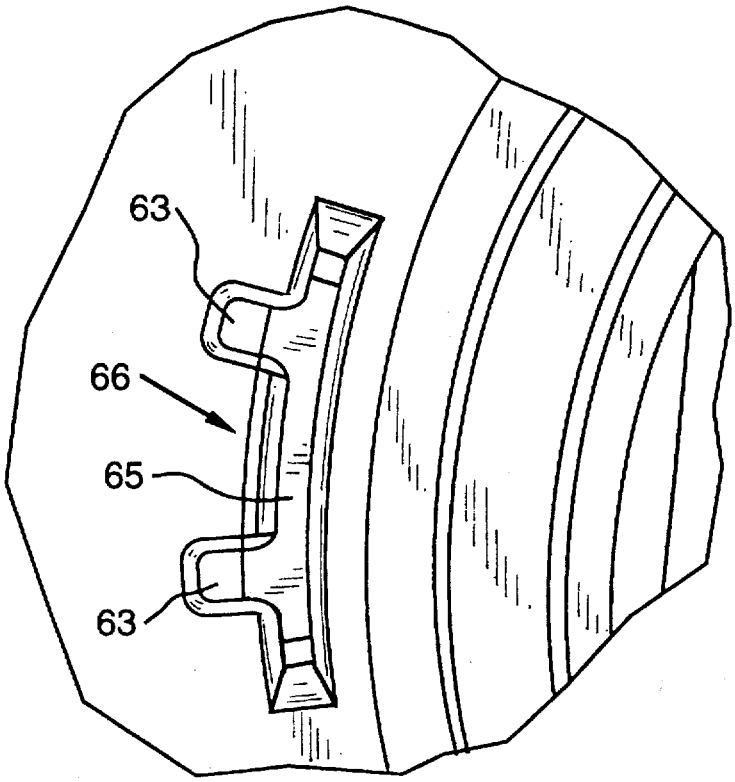
FIG. 9 is an enlarged view of a post member of the heating unit housing shown in FIG. 6 and indicated in hidden lines.
Figure 10:
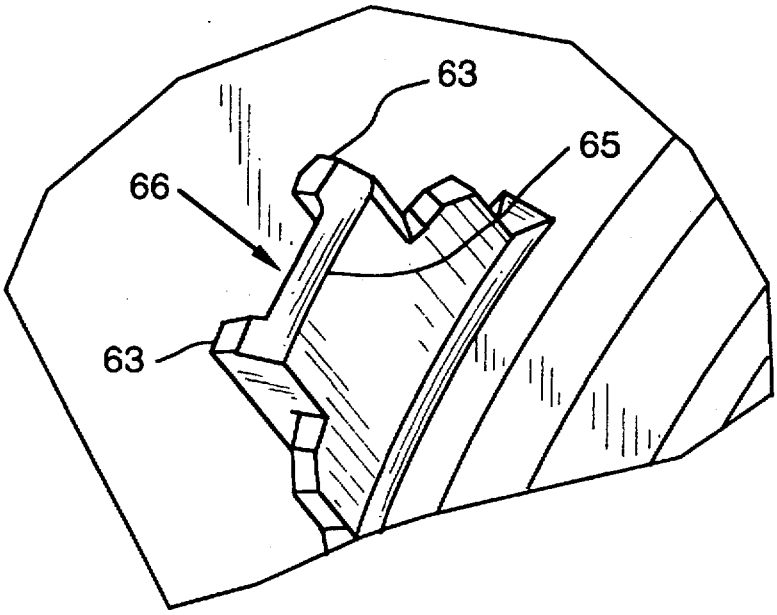
FIG. 10 is an enlarged view of the post member of the presently preferred embodiment of the heating unit housing shown in FIG. 7 and indicated with hidden lines.
Figure 11:
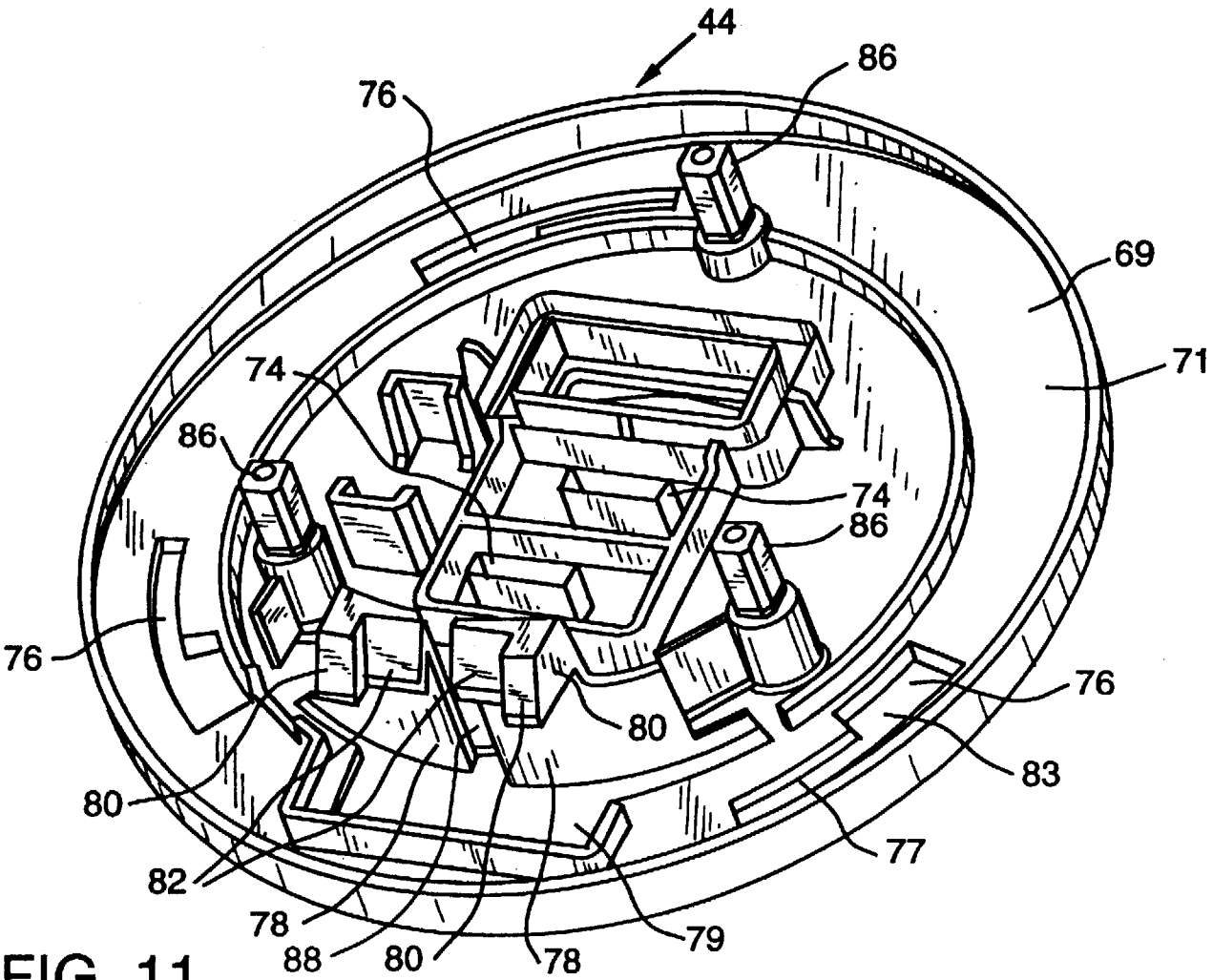
FIG. 11 is a top perspective view of the front of the heating unit holder of the heating unit assembly shown in FIG. 1.
Figure 12:
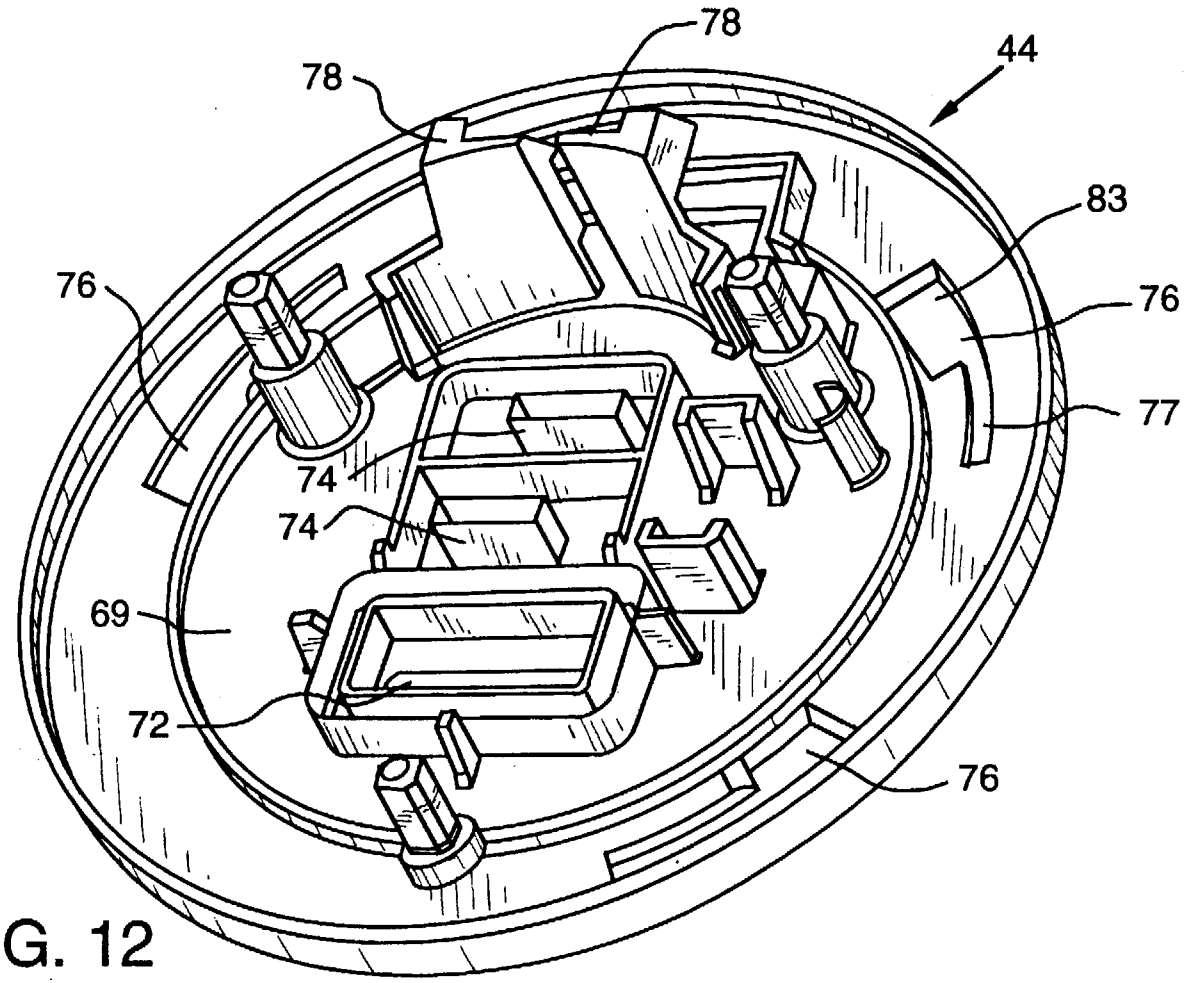
FIG. 12 is a top perspective view of the back of the heating holder shown in FIG. 11.
Figure 13:
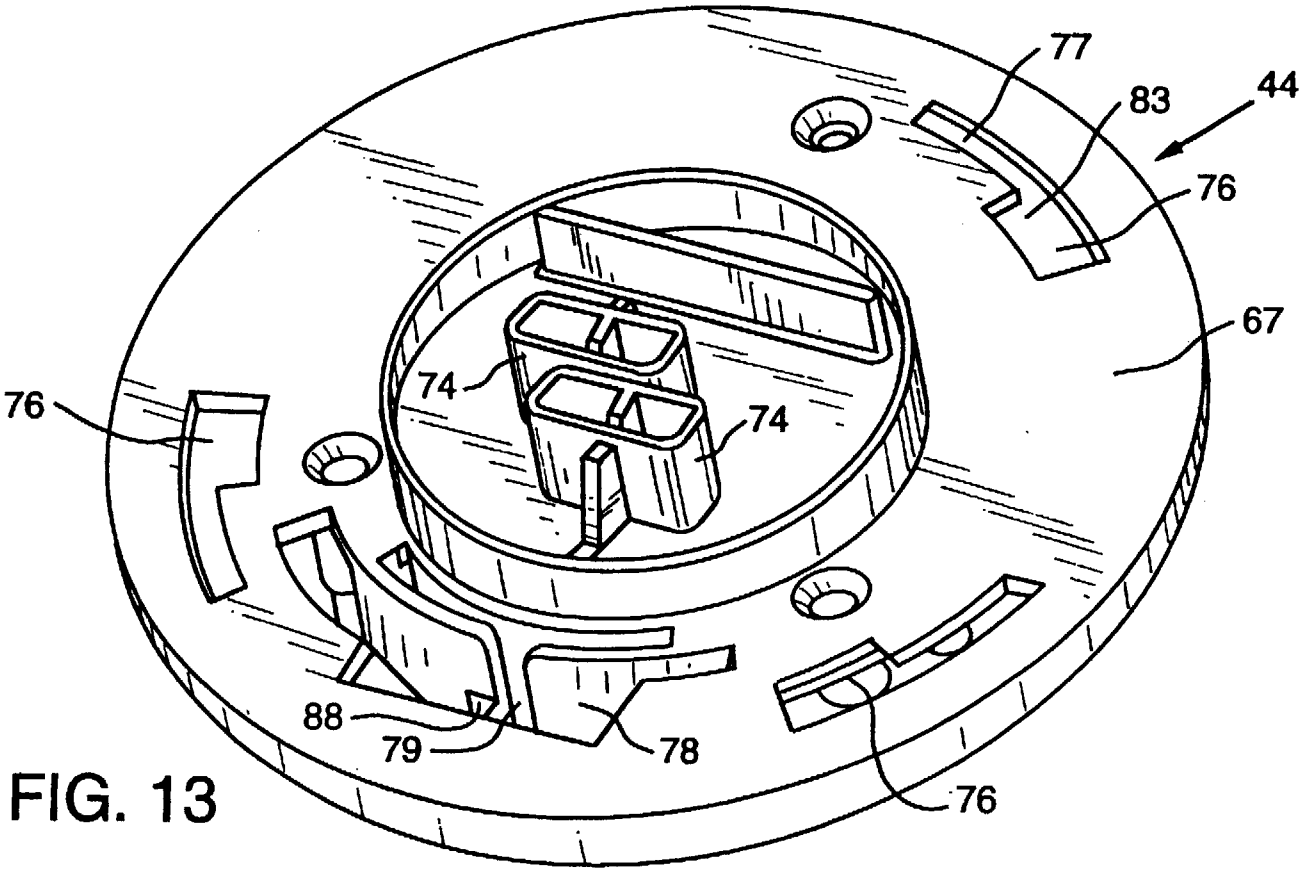
FIG. 13 is a bottom perspective view of the front of the heating unit holder shown in FIG. 11.
Figure 14:
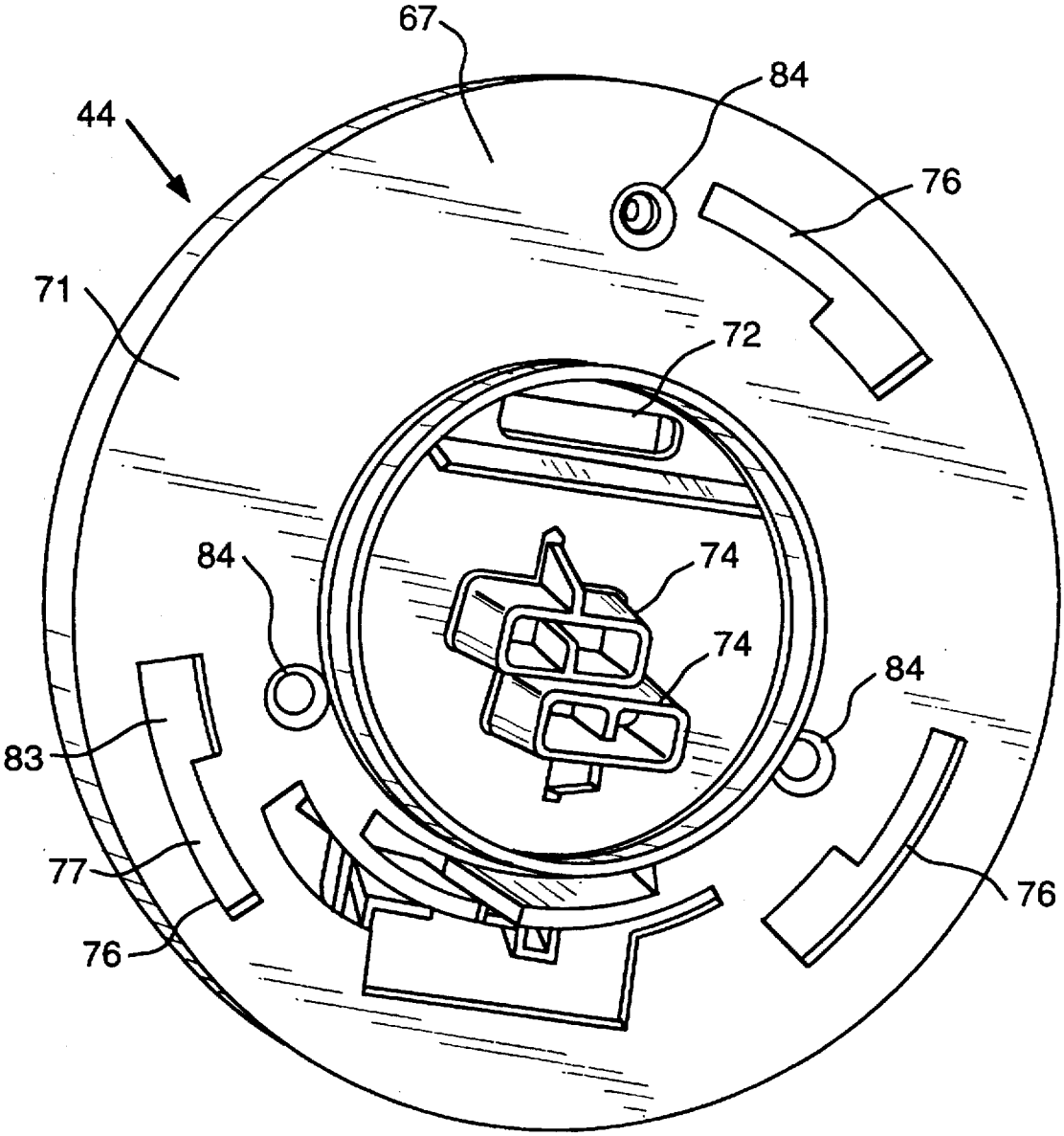
FIG. 14 is a bottom perspective view of the back of the heating unit holder shown in FIG. 13.

As shown in FIGS. 6 through 8, three projections 64 which are L-shaped extend from the flange surface 62. The L-shaped projections 64 have two legs 65 and 67, one leg 65 extends perpendicular from the flange surface 62 and the other leg 67 of the projection extends substantially parallel to the flange surface 62. Also extending from the flange 62 is post member 66. The post member 66, which can be seen in greater detail in FIGS. 8 through 10, has a wall 65 and two arms 63 extending from the wall 65 away from the center of the heating unit housing 42. Locking tabs 70 are provided on the flange 62 adjacent the exterior cylindrical member 56 for attaching the heating unit assembly to the reservoir 22.

FIGS. 11 through 14 illustrate in detail the heating unit holder 44 of the presently preferred embodiment of the heating unit assembly 24. The heating unit holder 44 has a bottom portion 67 and a top portion 69 and is a substantially circular body having a planar member 71 with a recess 72 positioned substantially in the middle section thereof. Two connection members 74 are also positioned in the middle section of the planar member 71 and three L-shaped openings 76 are located around the outer portion of the substantially circular planar member 71. The L-shaped openings 76 have a leg 83 with a wide opening and a leg 77 with a smaller opening. Two locking fingers 78 extend substantially perpendicular from the planar member 71 and include an enlarged head 80 with a split-inclined surface 82. The split-inclined surface 82 allows both the standard electrical plug used in the United States and the standard electrical plug used in Europe to be used as the key without changing the heating unit holder configuration. At least one flexible locking finger 78 has a ledge 88 extending longitudinally with respect to the locking finger 78. Three lugs 86 are provided on the front portion of the planar member 71 to allow the heating unit holder 44 to connect with the cover member 40. The lugs 86 are press fit into the boss members 49. The connection members 74 are holes which the electrodes 30 having dimples (not shown) can be friction fit within, although other means for connection may be provided. The recess 72 allows vapors being emitted from the water reservoir to pass therethrough and then into the atmosphere through aperture 34. A cavity 79 is also provided in the planar member 71 adjacent the locking fingers 78.

When the vaporizer is assembled, the water reservoir 22 is filled with water and the heating unit assembly 24 is placed therein. In order to assemble the heating unit assembly 24 the electrodes 30 must first be friction fit within the connection members 74 of the heating unit holder 44. The heating unit holder 44 is then mounted on the heating unit assembly housing 42 such that the electrodes 30 extend within the interior cylindrical body 58 and the L-shaped openings 76 extend over the L-shaped projections 64 and the L-shaped projections 64 extend through the L-shaped openings 76. Further the post member 66 must be aligned such that it extends through the cavity 79 which is adjacent to the locking fingers 78. Then the heating unit holder 44 is rotated such that the first legs 65 of the projections 64 extend into the smaller leg 77 of the L-shaped openings 76. In the locked position, the combination of the cover member 40 and the heating unit holder 44 is secured in a fixed position relative to the heating unit housing 42. The locked position is defined by an arm 63 engaging the ledge 88 of the locking finger 78. The cover member 40 which is has been connected to the heating unit holder 44 such that the key apertures 50 are in alignment with the locking fingers 78 and the recess 72 of the planar member 71 is alignment with the aperture 34. Further, lugs are friction fit within the bores 49 connecting the heating unit holder with the cover 40.

Figure 3A:
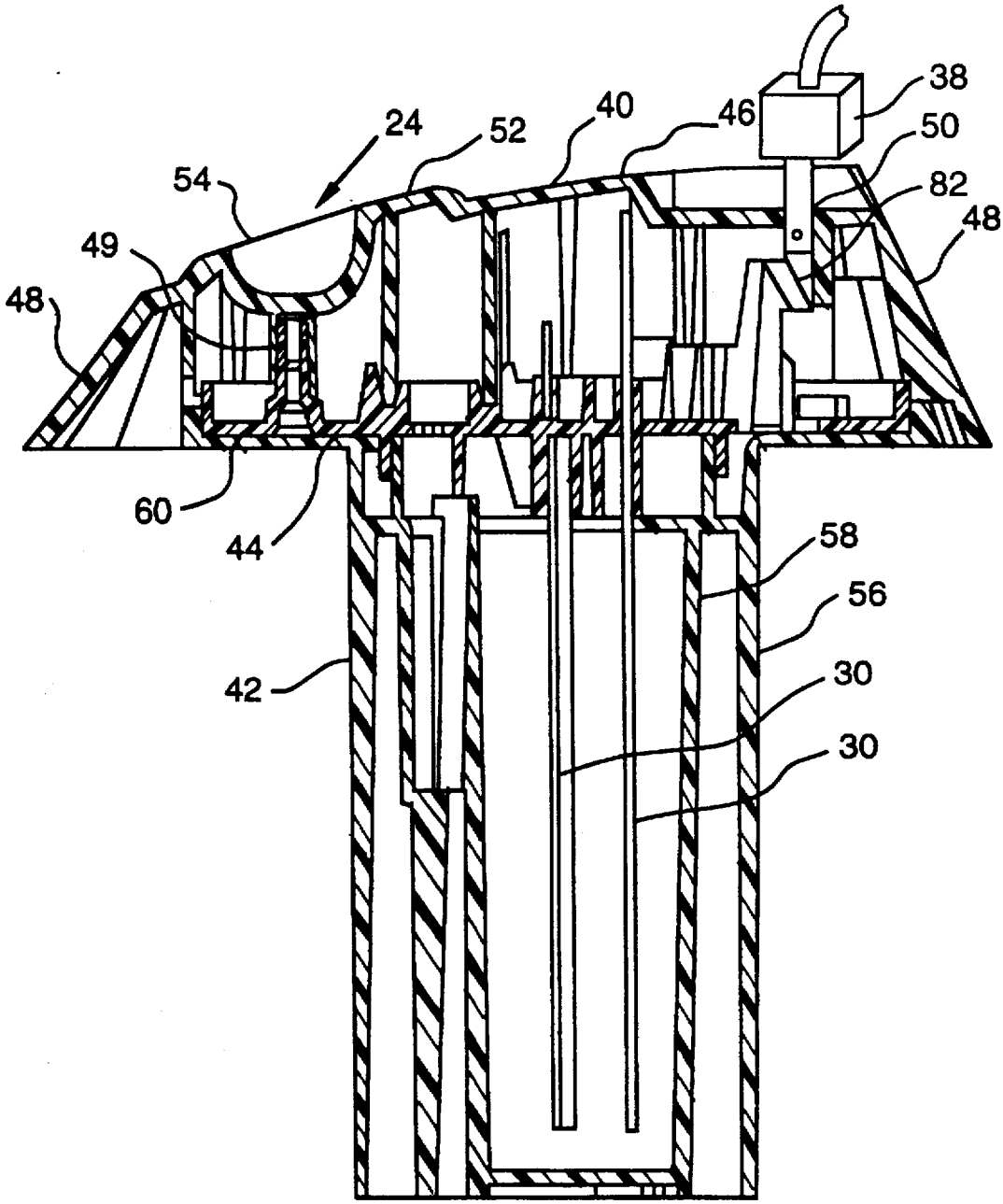
FIG. 3*a* is a sectional view of the heating unit assembly shown in FIG. 2 taken along line IIIa—IIIa.

As can be seen from the structure described above, the cover 24 is prevented from being removed from the heating unit housing 42 by the L-shaped projections 64 and L-shaped openings 76 which form a connecting mechanism and the flexible locking fingers 78 and the post member 66 which form a locking mechanism. Once the plug 38 is inserted into the aperture holes 50 as can be seen in FIG. 3*a*, the prongs 39 of the plug 38 will engage the inclined surfaces 82 of the locking fingers 78 and cause the locking fingers 78 to flex and move away from the post member 66 thereby allowing the combination of the cover member 40 and the heating unit holder 44 to rotate relative to the heating unit housing 42. When the L-shaped projections 64 are aligned with the wider legs 79 of the L-shaped openings 76 through such rotation the combination of the cover member 40 and the heating unit holder 44 can be separated from the heating unit housing 42 to expose the electrodes 30 for the above mentioned purpose of cleaning and replacement.

While the presently preferred embodiment of the invention has been described herein, it is distinctly understood that the invention is not limited thereto but may be otherwise variously embodied within the scope of the various claims.

We claim:

1. A heating unit assembly for a vaporizer comprising:

(a) a heating unit housing having a body for protecting a heating element, a flange extending from the body, at least one projection extending from the flange and a post member also extending from the flange;

(b) a cover having at least one key aperture for a key to fit within; and (c) a heating unit holder having at least one opening therein, and at least one flexible locking finger extending therefrom, the combination of the cover and the heating unit holder is mounted on the heating unit housing in a locked position such that the at least one projection extend through the at least one opening forming a connection between the combination of the cover and the heating unit holder and the heating unit housing and the at least one flexible locking finger engages the post member thereby locking the combination of the cover and the heating unit holder and the heating unit housing.

2. The heating unit assembly of claim 1 further comprising a key that is shaped to fit within the at least one key aperture and disengage the at least one locking finger from the post member.

3. The heating unit assembly of claim 2 wherein the key is at least one prong of an electrical plug attached to the vaporizer by an electrical cord.

4. The heating unit assembly of claim 1 wherein the body of the heating unit housing is generally cylindrical and the flange extends substantially perpendicularly from the circumference of the body, and a heating element is connected to and supported by the heating unit holder such that the heating element extends within the cylindrical body.

5. The heating unit assembly of claim 4 wherein the heating element is two electrodes.

6. The heating unit assembly of claim 1 wherein the combination of the cover and the heating unit holder is in an unlocked position when the key aperture is aligned with the at least one locking finger and the key is inserted within the key aperture contacting the at least one locking finger which flexes and moves away from the post member.

7. The heating assembly of claim 6 wherein the at least one locking finger has an enlarged head with an inclined surface that comes into contact with the key member.

8. The heating unit assembly of claim 7 wherein the inclined surface is a split-inclined surface.

9. The heating assembly of claim 1 wherein the projections are L-shaped having a first leg which extends substantially perpendicular from the flange and a second leg which extends substantially parallel to the flange.

10. The heating assembly of claim 9 wherein the openings are L-shaped having a wider leg opening and a smaller leg opening which form the L-shaped opening, and wherein when the combination of the cover and the heating unit holder is in the locked position the first leg of the at least one L-shaped projection extends through the smaller leg opening.

11. The heating unit assembly of claim 1 wherein the Post member has two arms and the at least one locking finger has a ledge extending longitudinally relative to the at least one locking finger which engages one of the two arms of the post member.

12. The heating unit assembly of claim 1 wherein the post member has a wall with at least two arms extending substantially perpendicular therefrom.

13. The heating assembly of claim 1 further comprising a second body positioned within the heating unit housing body.

14. The heating unit assembly of claim 1 wherein the heating unit holder further comprises two holes for connecting two electrodes having dimples to the heating unit holder forming a friction fit.

15. The heating unit assembly of claim 1 wherein the heating unit holder has a cavity positioned adjacent the at least one locking finger and through which the post member extends.

16. The heating unit assembly of claim 1 wherein the heating unit housing, the heating unit holder and the cover are made of polypropylene.

17. A heating unit assembly for a vaporizer comprising:

(a) a heating unit housing having a cylindrical body for protecting a heating element, a flange extending substantially perpendicular from an end of the cylindrical body, three L-shaped projections disposed on the flange wherein one of two legs of each of the three projections extends substantially perpendicular from the flange and the other of the two legs of each of the three projections extends substantially parallel to the flange and a post member also extends substantially perpendicular from the flange;

(b) a heating unit holder having three substantially L-shaped spaced openings around the holder, an outlet and two flexible fingers extending substantially perpendicular from the holder and positioned adjacent to one another, at least one of the two flexible fingers having a rigid ledge and an enlarged head portion with an inclined surface;

(c) a cover having an outlet and at least one aperture for a key to fit within, the cover connected to the heating unit holder such that the cover outlet is aligned with the heating unit holder outlet and the combination of the cover and the heating unit holder mounted on the heating unit housing such that the three projections extend through the three openings and the rigid ledge of at least one of the two flexible fingers engage the post member locking the combination of the cover and the heating unit holder and the heating unit housing relative to one another in a locked position; and (d) an electrical cord having an electrical plug with two prongs and two ends, one end of the electrical cord is connected to the heating unit, the other of end of the electrical cord is attached to the electrical plug and wherein one of the two prongs is shaped to fit within the at least one key aperture and engage the inclined surface of the at least one of the two flexible fingers having the rigid ledge thus, disengaging the rigid ledge of the at least one flexible finger from the post member resulting in the heating unit assembly being in an unlocked position such that the combination of the cover and the heating unit holder can move relative to the heating unit housing.

* * * * *